United States Patent [19]

Shevach et al.

[11] Patent Number: 5,070,764

[45] Date of Patent: Dec. 10, 1991

[54] COMBINED REACTIVE AND PASSIVE ARMOR

[75] Inventors: Haim Shevach, Kiriat Bialik; Gideon Rosenberg, Tiveon; Yehuda Partom, Haifa; Samuel Friling, Kiriat Ata; Moshe Benyami, Haifa; Yoav Erlich, Yuvalim, all of Israel

[73] Assignee: The State of Israel, Ministry of Defense, Rafael Armament, Tel Aviv, Israel

[21] Appl. No.: 710,980

[22] Filed: Jun. 6, 1991

Related U.S. Application Data

[63] Continuation of Ser. No. 467,042, Jan. 18, 1990, abandoned.

[30] Foreign Application Priority Data

Jan. 18, 1989 [IL] Israel ..... 88986

[51] Int. Cl.[5] ..... F41H 5/00

[52] U.S. Cl. ..... 89/36.17; 89/36.04; 89/36.08; 89/36.12; 109/36; 109/81

[58] Field of Search ..... 89/36.02, 36.04, 36.08, 89/36.12, 36.17; 109/36, 37, 81

[56] References Cited

U.S. PATENT DOCUMENTS 5,012,721 5/1991 Medin et al. ..... 89/36.17

*Primary Examiner*—Stephen C. Bentley
*Attorney, Agent, or Firm*—Helfgott & Karas

[57] ABSTRACT

Reactive armor elements each holding at least one reactive assembly of the kind in which an explosive layer is sandwiched between two metal plates, which is paired with a passive assembly comprising a layer of swellable material sandwiched between two metal plates. In each such pair the reactive assembly is outermost.

21 Claims, 8 Drawing Sheets

COMBINED REACTIVE AND PASSIVE ARMOR

This is a continuation of application Ser. No. 467,042, filed Jan. 18, 1990, now abandoned.

BACKGROUND OF THE INVENTION

The present invention concerns elements for making a protective reactive armor to be fitted on the outside of an enclosure liable to be exposed to attack by shaped-charge warheads and kinetic energy projectiles. Examples of enclosures protectable by a reactive armor made of elements according to the invention are armored land vehicles such as battle tanks, armored personnel carriers, armored fighting vehicles, armored, self-propelled guns and the like; armored marine vessels; armored static structures such as buildings, above-ground portions of bunkers, container tanks for the storage of fuel and chemicals and the like; etc. A reactive armor element according to the invention may be a basic type armor made integral with a conventional passive armor element, or alternatively of the add-on type.

Warheads with shaped-charge munition, also known as hollow charge munition, are known to pierce armor and thereby destroy from within objects located inside an armored enclosure. This capacity of a shaped charge results from the fact that upon detonation there forms an energy-rich jet also known as "thorn" or "spike" which advances at very high speed of several thousand meters per second and is thereby capable of piercing even relatively thick armor walls.

In U.S. Pat. No. 4,368,660 there is described an arrangement which purports to afford protection against the penetrating effect of an exploding shaped charge. According to that proposal there is provided a continuous wall structure having an explosive layer sandwiched between two wall members of an inert material, e.g. a metal, and being so arranged that the axis of an impinging projectile and of the jet formed upon detonation, includes with the surface of the wall structure an acute angle of say 45°. According to said U.S. patent, when a jet of a hollow charge projectile penetrates the upper surface of such a protective arrangement it initiates the explosive layer and in consequence the walls thereof are thrown apart in opposite directions, both essentially normal to their surfaces. Thus one of the wall members moves in the direction of the protected substrate while the other moves away and in consequence and due to the acute angle included between the jet and the wall member surfaces, the jet is successively intersected by different portions of the moving wall members with the consequence that the mass and energy of the jet are rapidly consumed whereby the jet is attenuated.

A similar arrangement is disclosed in GB-A-1,581,125 with the sole difference that in accordance with that disclosure the arrangement of the layer of explosive substance may optionally be covered only on one side by a layer of a non-combustible material.

An improved protective armor is disclosed by the present applicants in their U.S. Pat. No. 4,741,244 and the corresponding EP-B1-0 161,390. This improved protective armor is of the add-on type and consists of a plurality of elements each comprising a cover member having suspended therefrom on the side that faces the substrate at least one explosive insert comprising an explosive layer sandwiched between two metal plates such that when the element is mounted on a substrate the explosive insert remains distant therefrom.

Prior art reactive armors have the drawback that due to the intrinsic inertia of the reactive system and the high velocity of the jet head, a front portion of an oncoming jet manages to penetrate and reach the main armor practically without any attenuation, and although such a head portion accounts only for a fraction of the energy and mass liberated by a shaped detonating charge, it is nevertheless liable to cause damage. A further drawback of known reactive armors of the kind specified is due to the fact that in operation the innermost metal plate of the two plates between which the explosive charge is sandwiched, i.e. that plate that is closest to the main, passive armor, is hurled against the latter and the resulting impact may cause internal damage such as spalls and mechanical deformation, and also undesired shocks and vibration. In case of deformation of the inner side of a wall portion in an armored vehicle, operative parts such as the engine, the communication system, the weaponry and the like are liable to be damaged. Similar damage is liable to occur in consequence of spalling in which case, moreover, personnel is liable to be injured by inwardly hurled spalls and hydraulic, electric and fuel systems are liable to be damaged.

SUMMARY OF THE INVENTION

It is the object of the present invention to provide a new, improved reactive armor element for making a protective reactive armor free of the above deficiencies.

In accordance with the present invention there is provided an element for making a reactive armor effective against shaped charge warheads and kinetic energy projectiles, comprising a casing holding at least one reactive mass and energy consuming assembly of the kind in which an explosive layer is sandwiched between two metal plates, characterized in that each of said reactor mass and energy consuming assemblies is paired with a passive mass and energy consuming assembly comprising a layer of swellable material sandwiched between two metal plates, the reactive mass and energy consuming assembly of each pair being outermost.

In accordance with one embodiment of the invention the paired assemblies are spaced from each other. In accordance with another embodiment the paired assemblies are coupled together and have a common intermediary metal plate. By a modification of such an embodiment the intermediary metal plate is removed and the layer of swellable material is applied directly to the explosive layer.

A reactive armor element according to the invention may be integral with a basic armor element or be of the add-on type.

The invention further provides an enclosure fitted with a reactive armor comprising elements of the kind specified. Enclosures included within the scope of the present invention comprise armored land vehicles such as battle tanks, armored personnel carriers, armored fighting vehicles, armored, self-propelled guns; armored marine vessels; armored container tanks for holding fuel and chemicals; armored buildings; and the like.

Where in operation a reactive armor element according to the invention is hit by a jet generated by an oncoming shaped charge warhead and forming an acute angle with the protective assemblies, the explosive charge of the reactive assembly is initiated whereupon that assembly functions as a conventional reactive armor with the two metal plates between which the explosive charge was sandwiched being thrown apart in directions normal to their surfaces. The head portion of the jet which, due to its high speed and the inertia of the reactive assembly, as a rule penetrates therethrough without any significant attenuation, is intercepted by the passive assembly in which the metal plates are driven apart by the swellable material and the mass and energy of the head portion of the jet are partly consumed whereby such head portion is attenuated. In consequence, the likelihood of any damaging perforation of the main, passive armor of the protected enclosure is significantly reduced. The main and tailing portions of the jet are then attenuated by a mass and energy consuming abrasion mechanism as explained in detail in U.S. Pat. No. 4,741,244 the disclosure of which is incorporated herein by reference.

Upon the initiation of the reactive, mass and energy consuming assembly, the innermost metal plate thereof is thrown in direction of the main, passive armor. In its flight the plate is intercepted by the associated passive mass and energy consuming assembly and in this way the likelihood of spalling, deformation, shocks and vibrations resulting from the impact of the innermost metal plate of the reactive assembly on the main armor is in accordance with the invention significantly reduced.

It has been found in accordance with the present invention that a reactive armor made of elements of the kind specified, is also effective against armor-piercing kinetic energy projectiles such as, for example, subcaliber projectiles and armor piercing bullets even when such projectiles do not initiate the reactive armor. In such a situation the metal plates of an associated pair of protective assemblies produce an augmented spaced armor effect which is an aggregate of the effects produced by the plates of the two assemblies and is significantly larger than in conventional reactive armor where a similar effect is produced by only one or two plates. Thus, in this way the impact of a kinetic energy projectile is also mitigated in accordance with the invention, which is a significant improvement over conventional reactive armor which is designed not to be initiated by kinetic energy projectiles.

Preferably the reactive and passive mass and energy consuming assemblies that together constitute a pair of associated assemblies in accordance with the invention, are parallel to each other. They may, moreover, be either parallel to the outer wall of the casing or be mounted askew with respect thereto.

Where the pair constituting associated reactive and passive assemblies are parallel to the outer wall of the casing, the reactive assembly may be attached to the inner face of the outer wall or be distanced therefrom. In the former case, the outer wall may serve as the outermost plate of the reactive mass and energy consuming assembly.

The invention also provides a method of protecting an enclosure against shaped charge warheads and kinetic energy projectiles, comprising fitting such enclosure on the outside with a reactive armor made of elements of the kind specified.

DESCRIPTION OF THE DRAWINGS

Some specific embodiments of the invention will now be described, by way of illustration only, with reference to the annexed drawings in which.

DESCRIPTION OF SPECIFIC EMBODIMENTS

Figure 1:
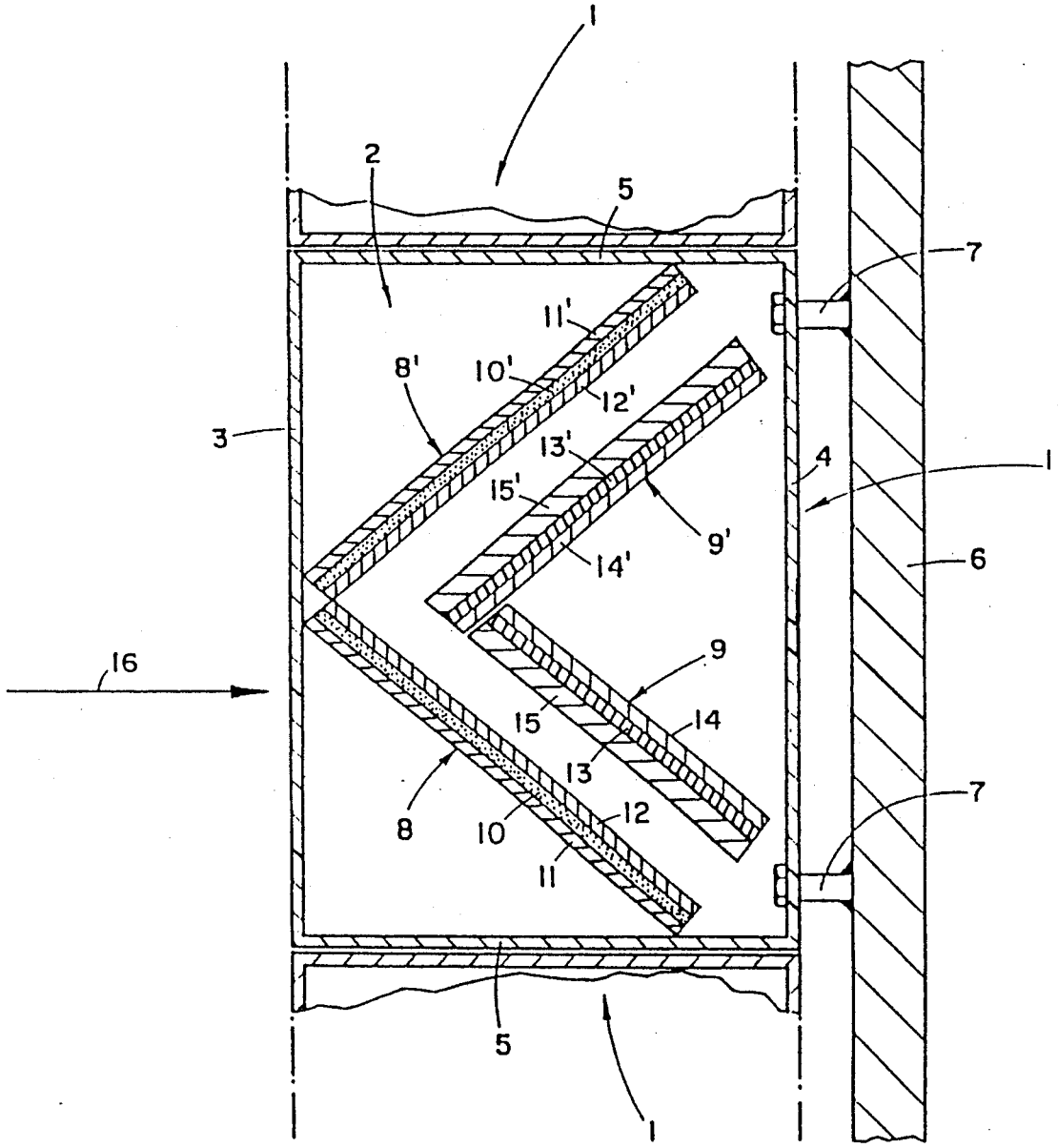
FIG. 1 is a diagrammatic longitudinal section showing elements in accordance with an embodiment according to the invention mounted on a main, passive armor.

The elements 1 according to the invention shown in FIG. 1, of which one is shown in full while only fractions are shown of the two contiguous ones are of the add-on type. Each element 1 comprises a casing 2 having an outer wall 3 and inner wall 4 and side walls 5 and is mounted on a main passive armor plate 6 by means of suitable members 7.

Mounted within casing 2 are two pairs of energy and mass consuming units (the details of the mounting are not shown), consisting each of spaced reactive and passive assemblies 8, 9 and 8', 9', respectively. The two assemblies 8, 9 and 8', 9' are shown to form two, essentially parallel V-shaped configurations.

Assemblies 8 and 8' are conventional reactive armor assemblies and they comprise a layer of explosive material 10, 10' sandwiched between metal plates 11, 12 and 11', 12', respectively.

The passive assemblies 9 and 9' comprise each a layer of a swellable, passive energy and mass consuming material 13, 13', e.g. of rubber, sandwiched between metal plates 14, 15 and 14', 15', respectively.

In FIG. 1, arrow 16 signifies a jet generated by an oncoming shaped charge warhead. The jet is shown to arrive normal to the outer wall 3 of casing 2 and as it penetrates therethrough it hits one of the reactive assemblies—assembly 8 in the case shown in FIG. 1—which then functions in the conventional way as described in U.S. Pat. No. 4,741,244 and corresponding EP-B1-0 161,390.

The head portion of jet 16 which remains essentially unattenuated is intercepted by the associated passive assembly 9 together with the main, attenuated portion of the jet. By this interception the swellable material 13 of assembly 9 is caused to swell whereby plates 14 and 15 are pushed apart which generates a mass and energy consuming effect similar to that generated by the moving plates 11 and 12 of the reactive assembly 8. In this way the head portion of jet 16 is attenuated and the attenuation of the main portion of jet 16 achieved by operation of the reactive attenuating assembly 8 is amplified, with the overall consequence that the so attenuated jet is no longer capable of perforating the main armor 6.

Due to the augmented attenuation achieved by a reactive armor according to the invention it becomes possible to reduce the thickness and weight of the main passive armor 6.

In the course of operation, the innermost plate 12 or 12' of the reactive assembly 8 or 8' is thrown in the direction of wall 4 and would normally penetrate therethrough and hit the main armor 6. However, in accordance with the present invention the innermost plate 12 or 12' of the reactive assembly 8 or 8' is intercepted by the associated passive assembly 9 or 9' and in this way deformations, spalling, shock and vibration normally caused by the impact of the innermost metal plate of a reactive armor element, are significantly mitigated.

A reactive armor according to the invention is also effective against armor piercing kinetic energy projectiles. Such projectiles will, as a rule, not initiate the explosive layer of the reactive mass and energy absorbing assemblies 8, 8'. This is so because in accordance with the present state of the art the layers 10 and 10' are, for reasons of safety, constituted by an explosive with a high initiation threshold. However the metal plates 11, 12, 14 and 15 and 11', 12', 14' and 15' produce a spaced armor effect which may further be enhanced by swelling of the swellable material 13, 13' and in this way the penetration capability of a kinetic energy projectile is significantly attenuated.

In FIGS. 2 to 8 constituent parts analogous to those in FIG. 1 are designated with the same numerals.

Figure 2:
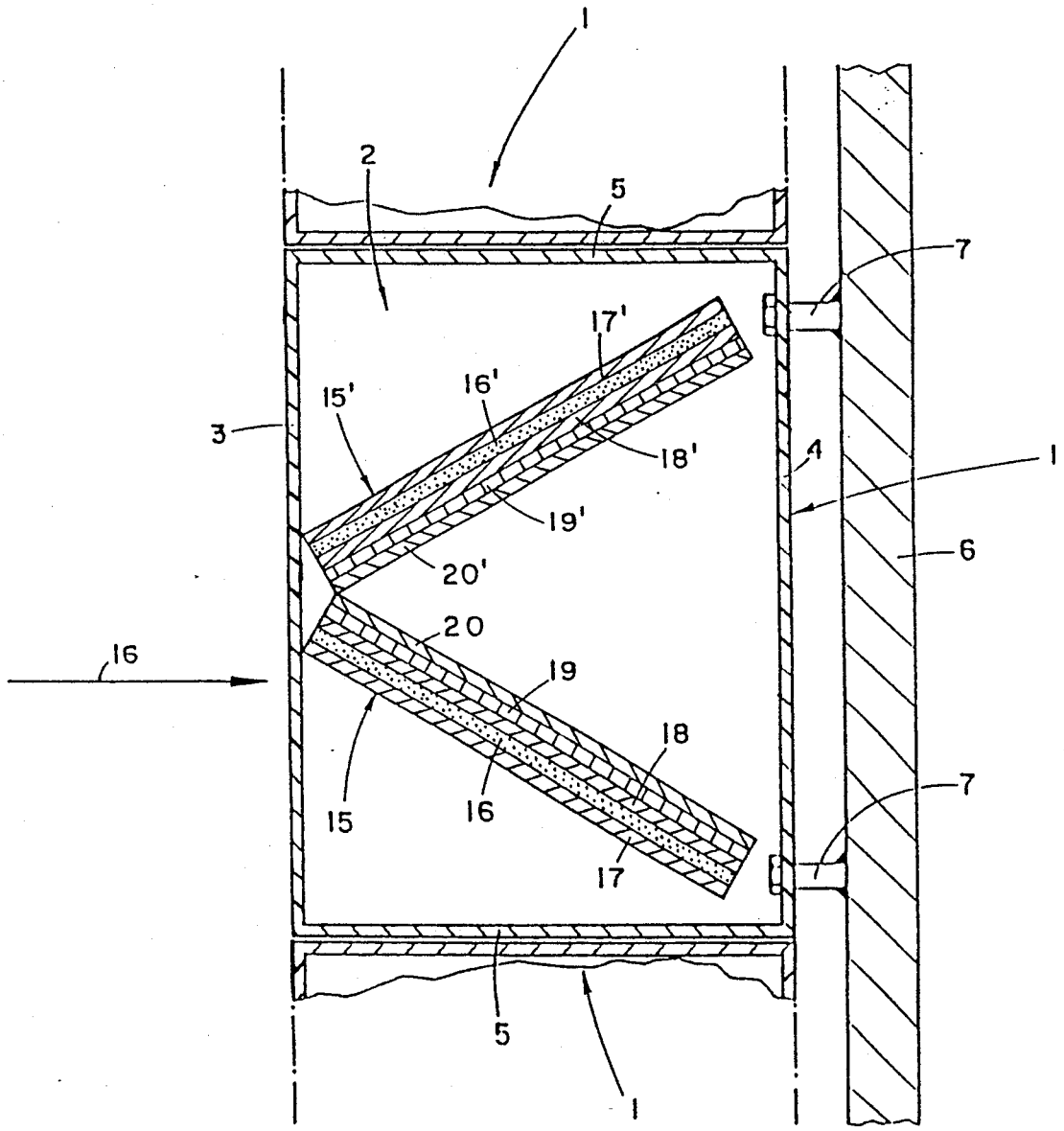
FIGS. 2 to 8 are diagrammatic longitudinal sections of further embodiments of the elements according to the invention.

Turning first to FIG. 2 which also shows an add-on embodiment, the reactive and passive assemblies are combined into two units 15 and 15'. Unit 15 comprises a layer of explosive material 16 sandwiched between metal plates 17 and 18 and a layer of a swellable passive energy attenuating material 19 sandwiched between metal plates 18 and 20, metal plate 18 thus being common to the reactive and passive assemblies. The structure of unit 15' is analogous with the various components being designated 16', 17', 18', 19' and 20', respectively. Similar as in FIG. 1, units 15 and 15' are ranged in V-shaped configuration.

Figure 3:
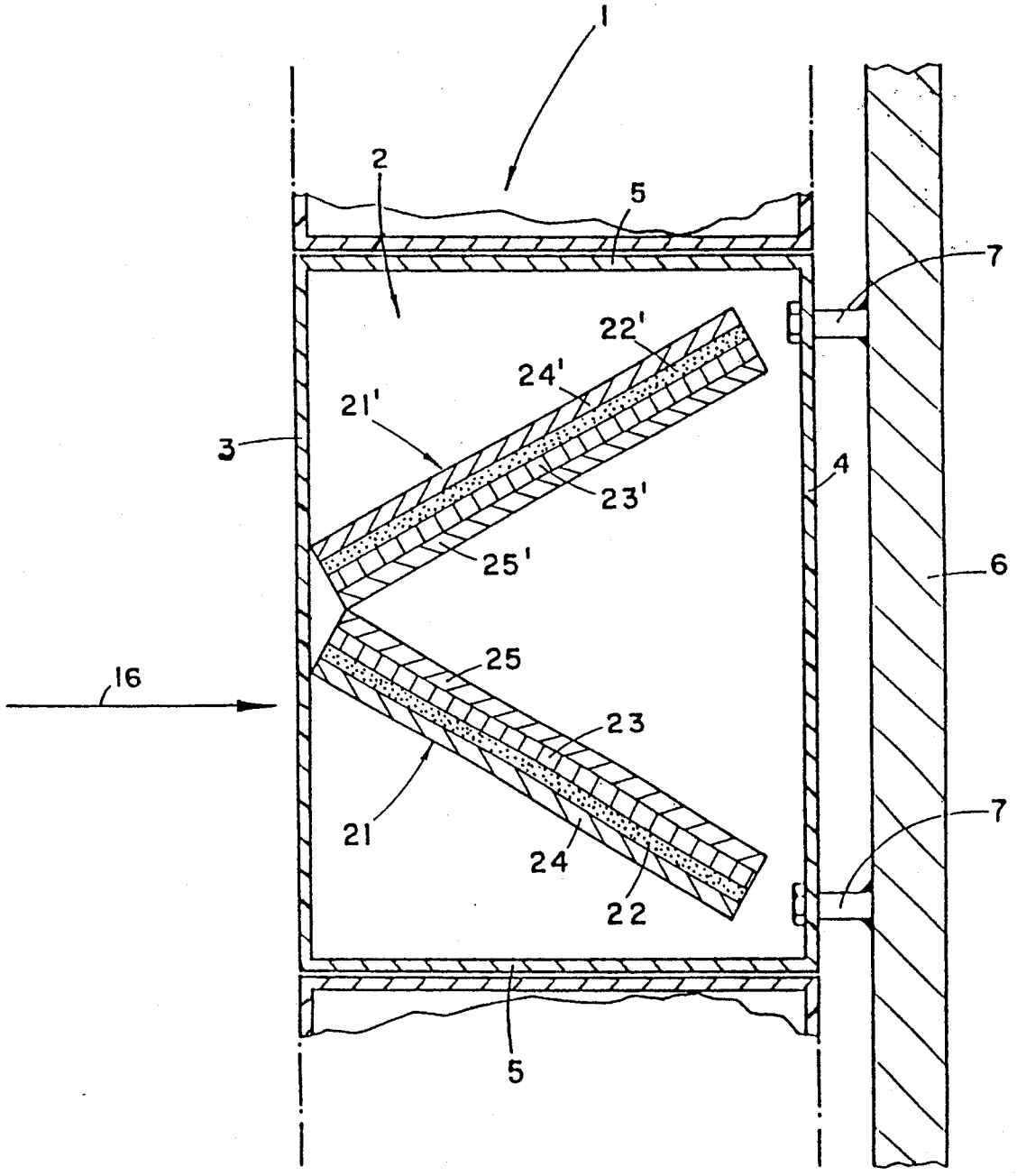

In the add-on embodiment of FIG. 3, units 21, 21' are again arranged in V-shaped configuration and each holds a reactive and a passive assembly in combination. However, as distinct from the embodiment of FIG. 2, in this case the explosive and swelling layers are contiguous. Thus, in unit 21 an explosive layer 22 and a layer 23 of swellable material bear on each other and they are jointly sandwiched between metal plates 24 and 25. The second unit 21' is of similar design with the components being designated 22', 23', 24' and 25', respectively.

Figure 4:
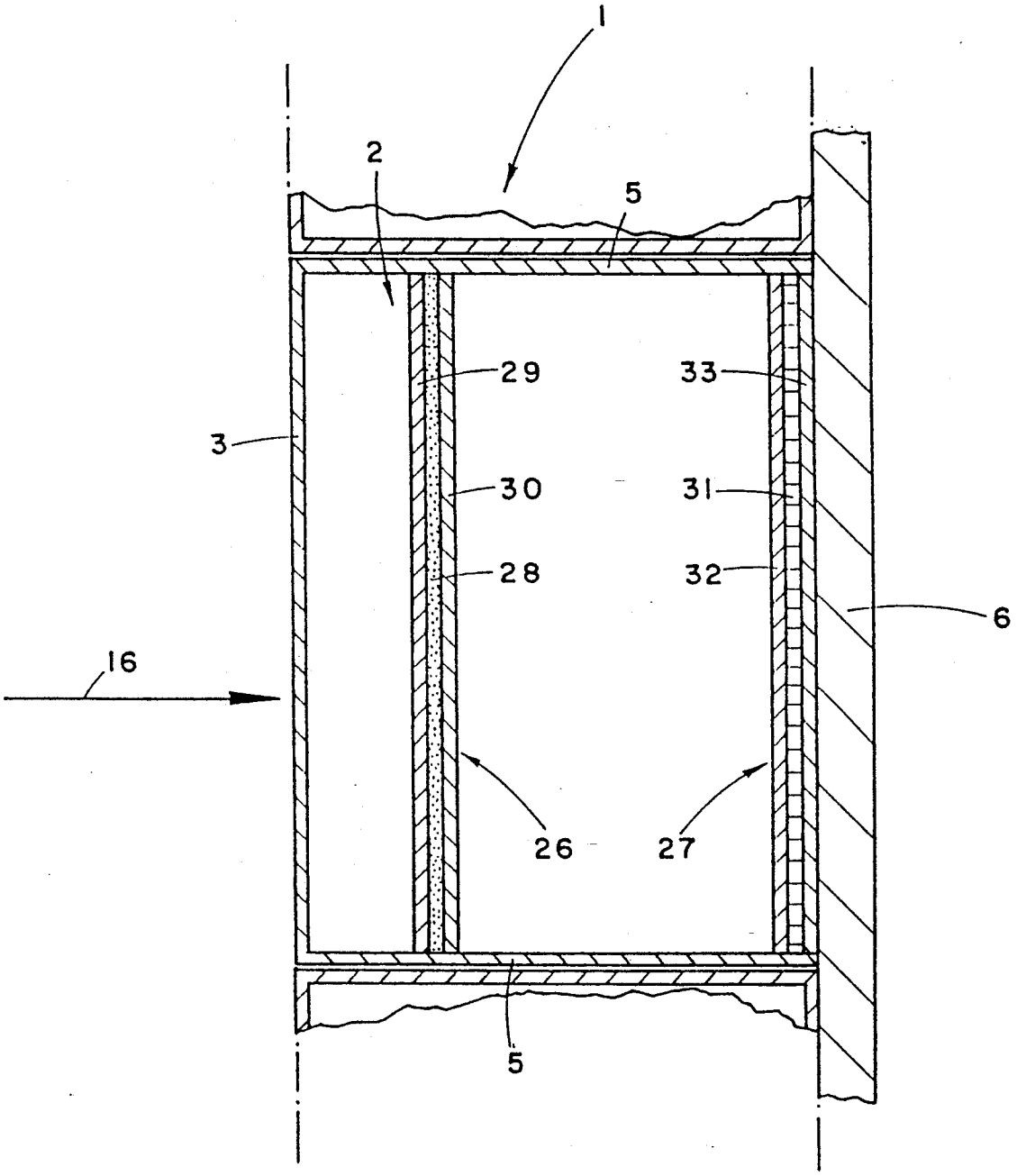
Figure 5:
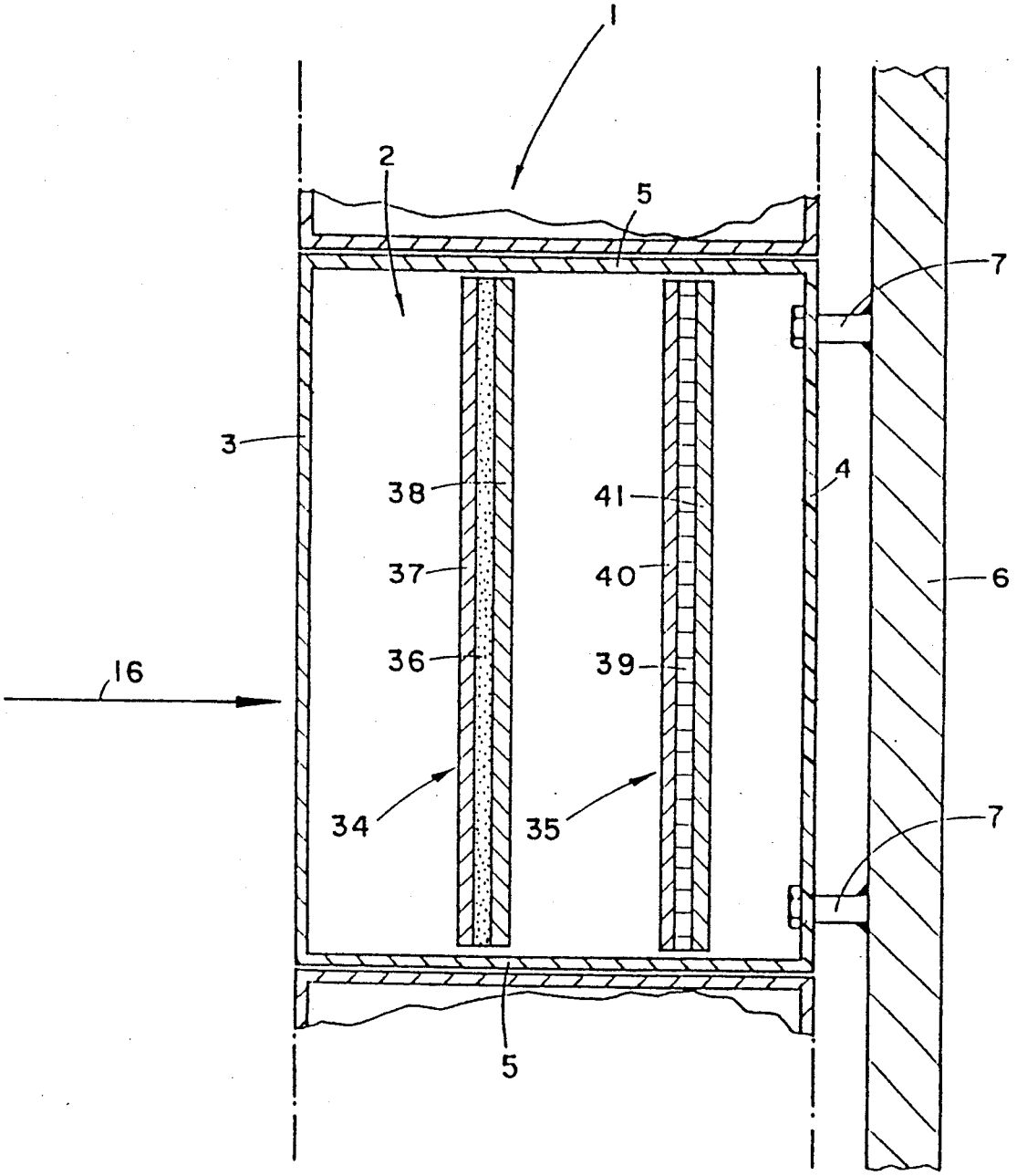

In the embodiment of FIG. 4, the reactive armor elements 1 are integral with the basic armor 6, and the reactive and passive assemblies are spaced from each other and extend in parallel to the outer wall of the casing. Thus, the reactive assembly 26 extends in parallel to the outer wall 3 at a distance therefrom and comprises an explosive layer 28 sandwiched between metal plates 29 and 30. The passive assembly 27 is spaced therefrom and bears directly on the basic armor 6, thus forming the inner wall of the casing. Assembly 27 comprises a layer of swellable material 31 sandwiched between metal plates 32 and 33.

The embodiment of FIG. 5 is again of the add-on type and comprises reactive and passive assemblies 34 and 35 extending across casing 2 in spaced relationship and in parallel to the outer and inner walls 3 and 4. The reactive assembly 34 comprises an explosive layer 36 sandwiched between metal plates 37 and 38 and the passive assembly 35 comprises a layer of swellable material 39 sandwiched between metal plates 40 and 41.

Figure 6:
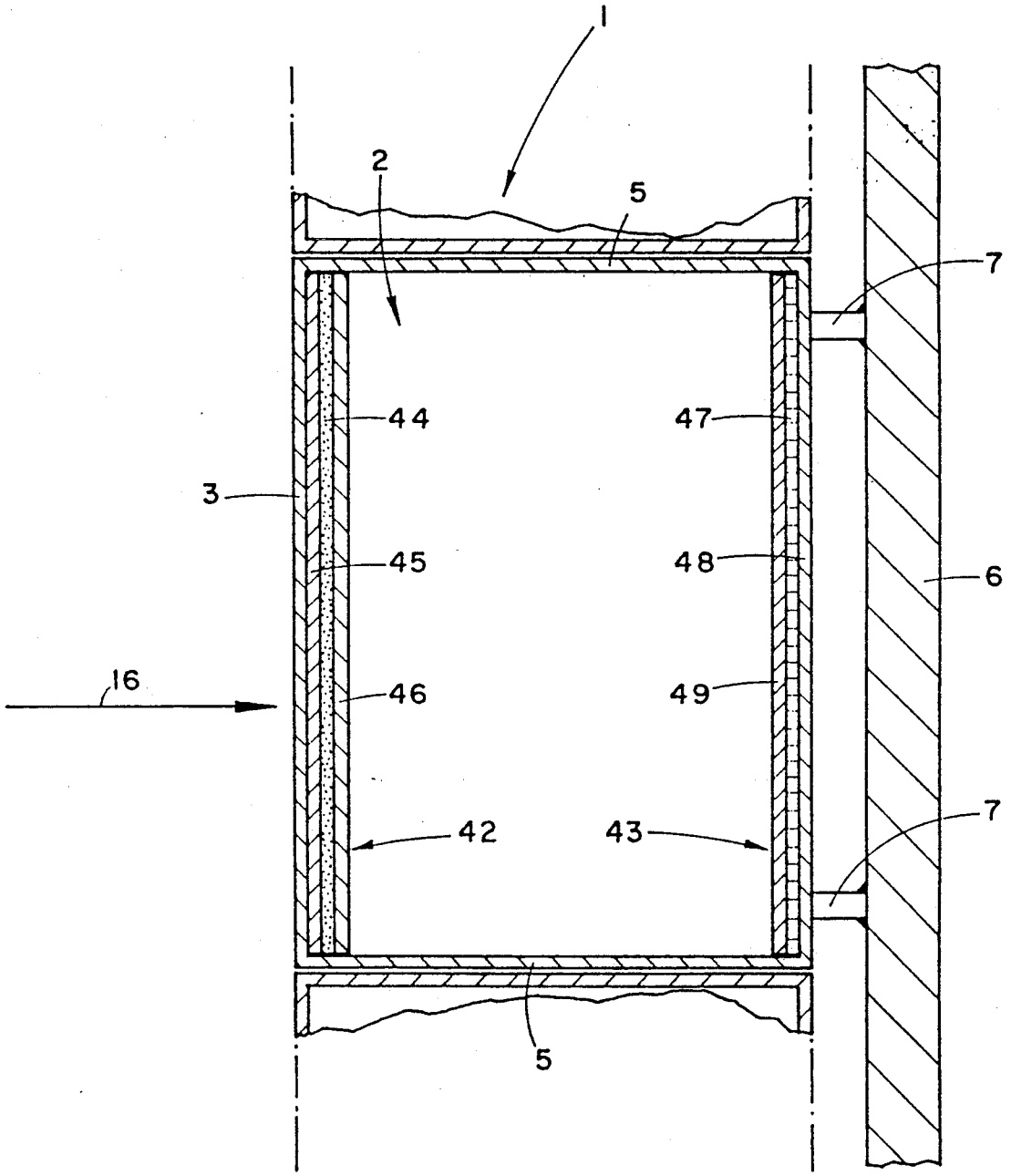

In the add-on embodiment of FIG. 6, the reactive and passive assemblies are associated with respectively the outer and inner walls of casing 2. However, whereas the reactive assembly 42 is attached to an existing outer wall 3 of the casing, the passive assembly 43 constitutes the inner wall of the casing. As shown, the reactive assembly 42 comprises an explosive layer 44 sandwiched between an outer metal plate 45 that bears on the outer wall 3 of the casing and an inner metal plate 46. The passive assembly 43 which constitutes the inner wall of casing 2, comprises a layer of swellable material 47 sandwiched between metal plates 48 and 49.

Figure 7:
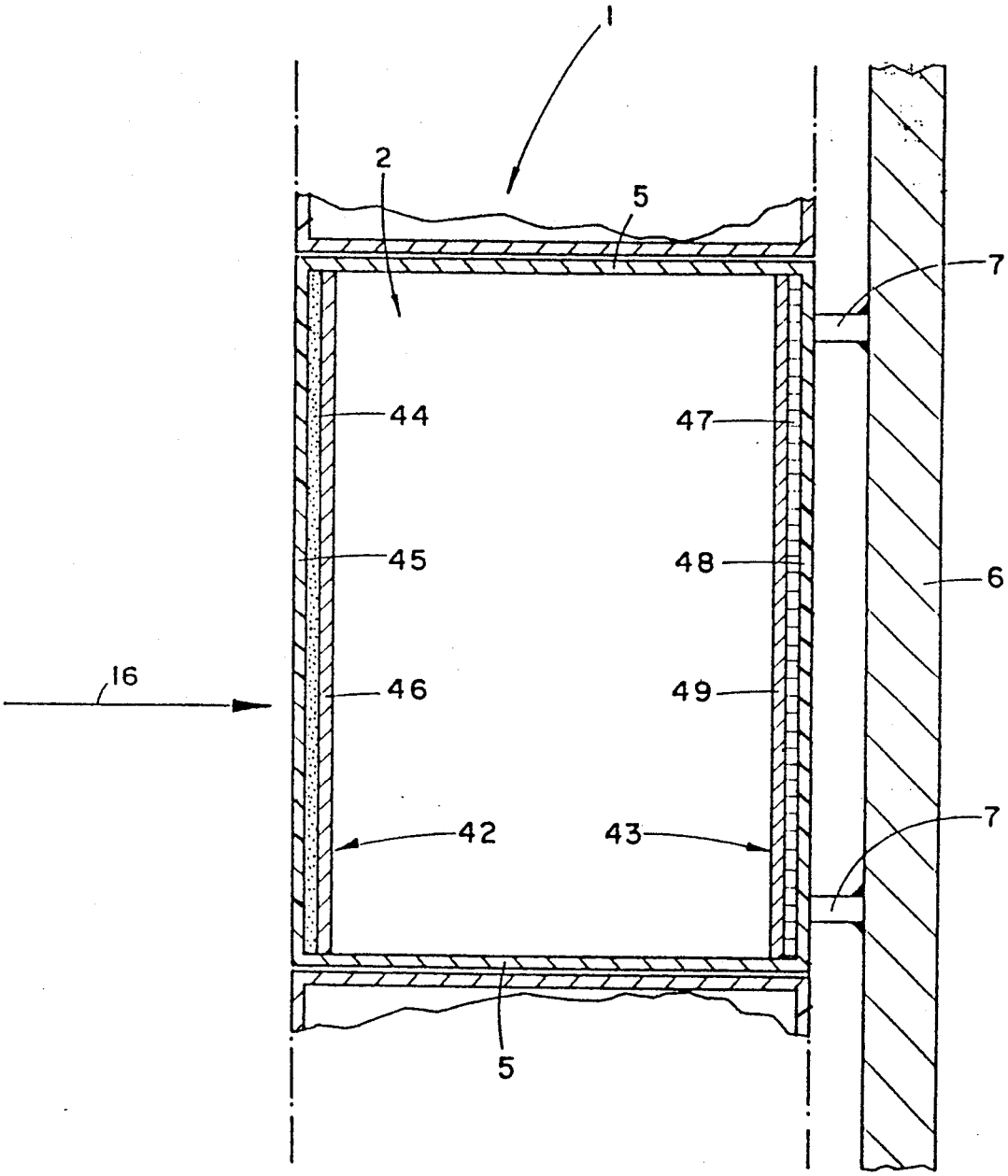

The add-on embodiment of FIG. 7 is essentially similar to that of FIG. 6 and the various components are designated with the same numerals. However, in this case the outermost plate 45 of the reactive assembly 42 constitutes the outer wall of the casing and the additional outer wall 3 is absent.

Figure 8:
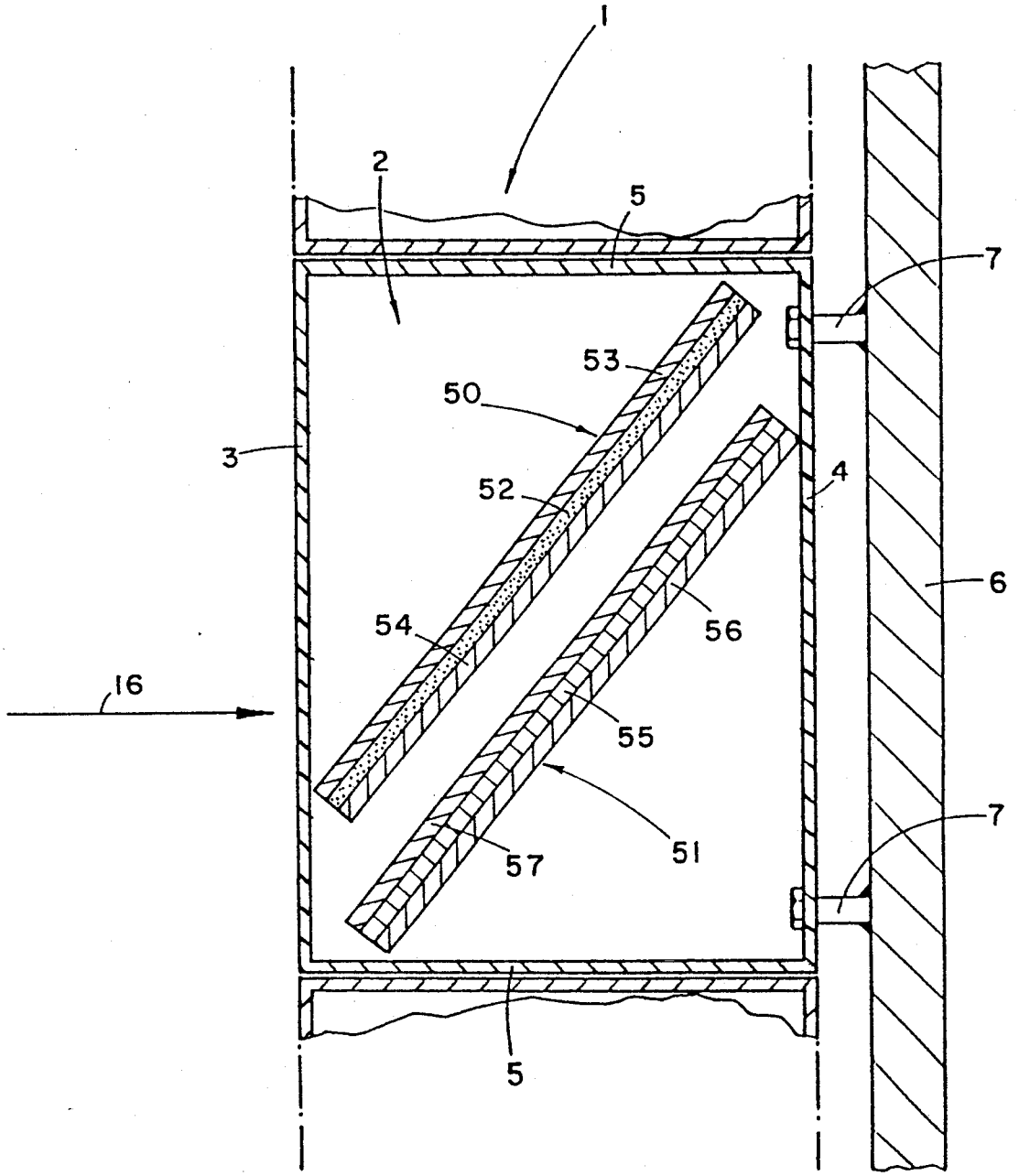

In the add-on embodiment of FIG. 8, the reactive and passive assemblies are askew with respect to the outer and inner walls 3 and 4 and extend across the casing in parallel to each other. It comprises a reactive assembly 50 and a passive assembly 51. Assembly 50 comprises a layer of explosive material 52 sandwiched between metal plates 53 and 54 and the passive assembly 51 comprises a layer of swellable material 55 sandwiched between metal plate 56 and 57.

We claim:

1. In an element for making a reactive armor effective against shaped charge warheads and kinetic energy projectiles, comprising a casing holding at least one reactive mass and energy consuming assembly of the kind in which an explosive layer is sandwiched between a first set of two metal plates, the improvement comprising at least one passive mass and energy consuming assembly comprising a layer of non-explosive swellable material sandwiched between a second set of two metal plates, said at least one passive mass and energy consuming assembly being paired with said at least one reactive mass and energy consuming assembly so that said assemblies face one another, wherein the reactive mass and energy consuming assembly of each pair is outermost, whereby upon hitting said outermost assembly by a jet generated by an oncoming shaped-charge and explosion thereof and following interception of the jet by said passive mass and energy consuming assembly of each pair, said swellable material is caused to swell to urge said two metal plates of said passive assembly to move apart thus producing a mass and energy consuming effect similarly to that generated by said reactive assembly so that an attenuation of the jet and a mitigation of the impact of an armor piercing kinetic energy projectile are improved.

2. An element according to claim 1, wherein the passive and reactive assemblies in each pair are spaced from each other.

3. An element according to claim 1, being integral with a basic armor element.

4. An element according to claim 1, being of an add-on type.

5. An element according to claim 2, wherein the passive and reactive assemblies in each pair are parallel to each other.

6. An element according to claim 1, wherein the passive and reactive assemblies in each pair are parallel to an outer wall of the casing.

7. An element according to claim 6, wherein the reactive assembly of a pair is attached to an inner face of the outer wall of the casing.

8. An element according to claim 7, wherein an outermost plate of the reactive assembly serves as the outer wall of the casing.

9. An element according to claim 1, wherein the passive and reactive assemblies in each pair are askew with respect to an outer wall of the casing.

10. An element according to claim 9, comprising a single pair of said reactive and passive assemblies extending across the casing.

11. An element according to claim 9, comprising two pairs of said reactive and passive assemblies forming together two essentially parallel, V-shaped configurations.

12. In an enclosure fitted with a reactive armor made of elements each comprising a casing holding at least one reactive mass and energy consuming assembly of the kind in which an explosive layer is sandwiched between a first set of two metal plates, the improvement comprising at least one passive mass and energy consuming assembly provided in each element and comprising a layer of swellable material sandwiched between a second set of two metal plates, said assemblies facing one another wherein the reactive mass and energy consuming assembly of each pair is outermost, whereby upon hitting said outermost assembly by a jet generated by an oncoming shaped-charge and explosion thereof and following interception of the jet by said passive mass and energy consuming assembly, said swellable material is caused to swell to urge said two metal plates of said passive assembly to move part thus producing a mass and energy consuming effect similarly to that generated by said reactive assembly so that an attenuation of the jet and a mitigation of the impact of an armor piercing kinetic energy projectile are improved.

13. An enclosure according to claim 12, being an armoured land vehicle.

14. An armored land vehicle according to claim 13, being a battle tank.

15. An armored land vehicle according to claim 13, being selected from the group consisting of armored personnel carriers and armored fighting vehicles.

16. An armored land vehicle according to claim 16, being an armored, self-propelled gun.

17. An enclosure according to claim 12, being an armored marine vessel.

18. An enclosure according to claim 12, being an armored container.

19. An enclosure according to claim 12, being an armored building.

20. An element for making a reactive armor effective against shaped charge warheads and kinetic energy projectiles, comprising a casing enclosing at least one reactive mass and energy assembly in which an explosive layer is sandwiched between two metal plates, and at least one passive mass and energy consuming assembly enclosed in said casing and comprising a layer of swellable material sandwiched between two metal plates, said at least one passive mass and energy consuming assembly being paired with said at least one reactive mass and energy consuming assembly, wherein the reactive mass and energy consuming assembly of a pair of said assemblies is outermost, and, wherein said passive and reactive assemblies in each pair are spaced from each other, whereby upon hitting said outermost assembly by a jet generated by an oncoming shaped-charge and explosion thereof and following interception of the jet by said passive mass and energy consuming assembly, said swellable material is caused to swell to urge said two metal plates of said passive assembly to move apart thus producing a mass and energy consuming effect similarly to that generated by said reactive assembly so that an attenuation of the jet and a mitigation of the impact of an armor piercing kinetic energy projectile are improved.

21. A method of protecting an enclosure against shaped charge warheads and kinetic energy projectiles, comprising fitting the enclosure on the outside thereof with a reactive armor made of elements each comprising a casing holding at least one reactive mass and energy consuming assembly in which an explosive layer is sandwiched between a first set of two metal plates, the method further comprising the steps of providing in each element at least one passive mass and energy consuming assembly comprising a layer of swellable material sandwiched between a second set of two metal plates, and pairing each reactive assembly with a respective passive assembly so that each reactive assembly faces the respective passive assembly and the reactive mass and energy consuming assembly of each pair is outermost, whereby an attenuation of a jet generated by an oncoming shaped-charge and a mitigation of the impact of an armor piercing kinetic energy projectile are improved.

* * * * *